United States Patent [19]

Hay

[11] 4,035,971

[45] July 19, 1977

[54] BUILDING CONSTRUCTION SYSTEM

[76] Inventor: Donald A. Hay, 7031 Persimmon Tree Road, Bethesda, Md. 20034

[21] Appl. No.: 642,117

[22] Filed: Dec. 18, 1975

[51] Int. Cl.[2] ..... E04G 1/04

[52] U.S. Cl. ..... 52/236.6

[58] Field of Search ..... 52/236, 630, 283, 602, 52/497, 236.6

[56] References Cited

U.S. PATENT DOCUMENTS

| | | | |
|---|---|---|---|
| 1,834,892 | 12/1931 | Betzler | 52/602 |
| 2,497,887 | 2/1950 | Hilpert | 52/236 |
| 2,648,877 | 8/1953 | Vermilya | 52/236 |
| 3,466,819 | 9/1969 | Giger | 52/303 |
| 3,470,660 | 10/1969 | Van Der Lely | 52/471 |

FOREIGN PATENT DOCUMENTS

| | | | |
|---|---|---|---|
| 695,433 | 10/1964 | Canada | 52/236.9 |
| 403,532 | 12/1933 | United Kingdom | 52/303 |

*Primary Examiner*—John E. Murtagh

[57] ABSTRACT

A construction system for buildings of the one-story or multi-story type which includes prefabricated elements comprising preformed panels for outside walls, floors, roofs and partitions together with metallic angle members for supporting floor and roof panels from the said wall panels, the system including pre-drilled holes in the panels and angle members for the reception of fastening devices, to the end that the erection of a building structure may be effected with the use of the foregoing preformed components in a simple, efficient and convenient manner and with a minimum of skilled labor.

1 Claim, 10 Drawing Figures

Fig. 1
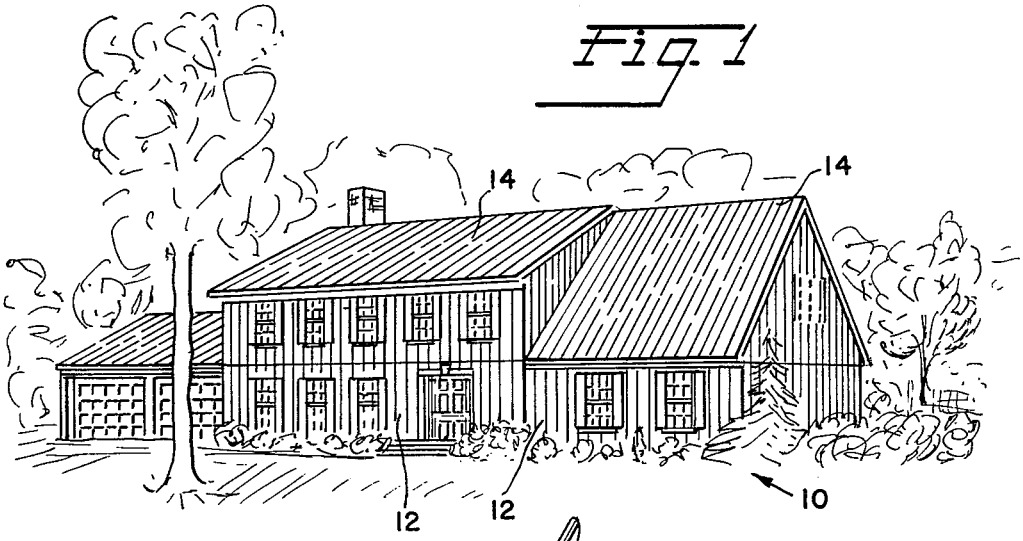
Fig. 2
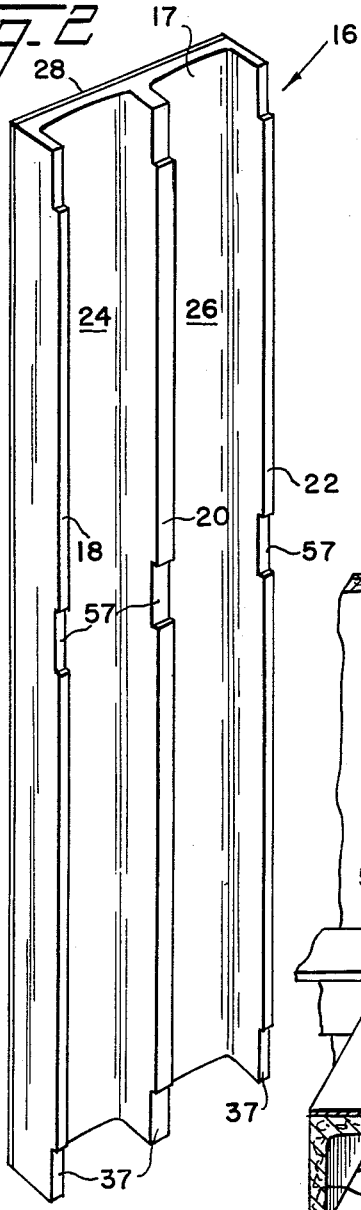
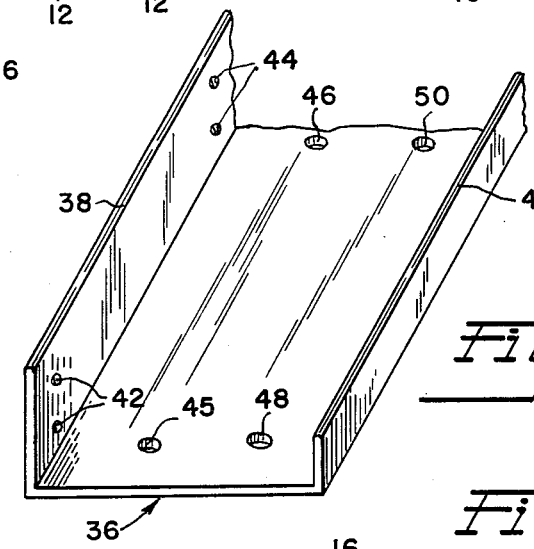
Fig. 3
Fig. 4
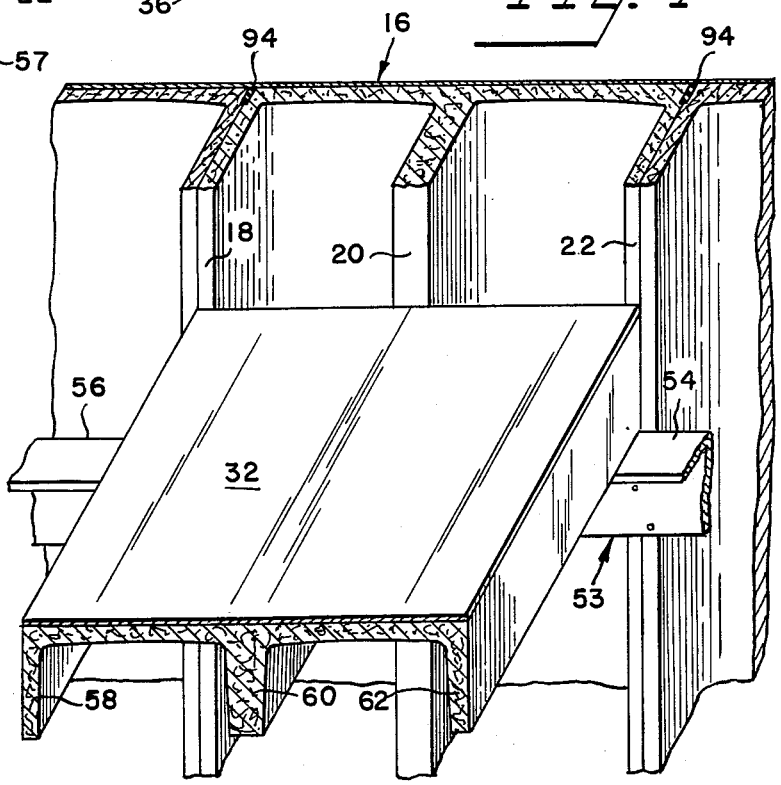

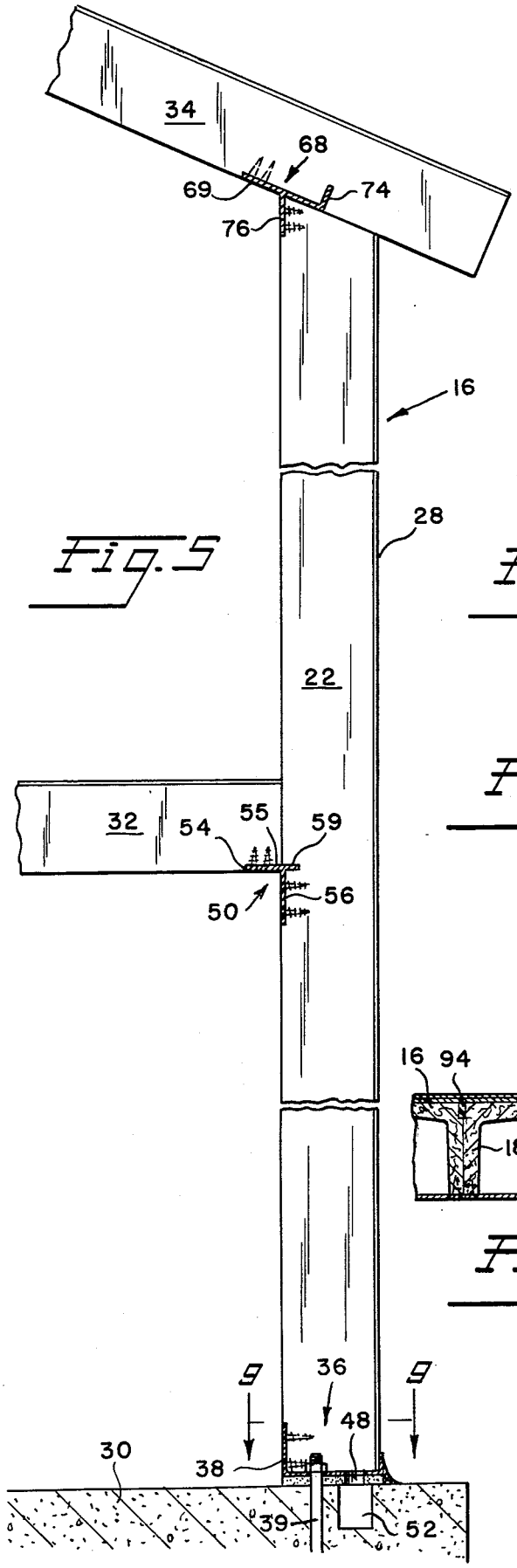
Fig. 5
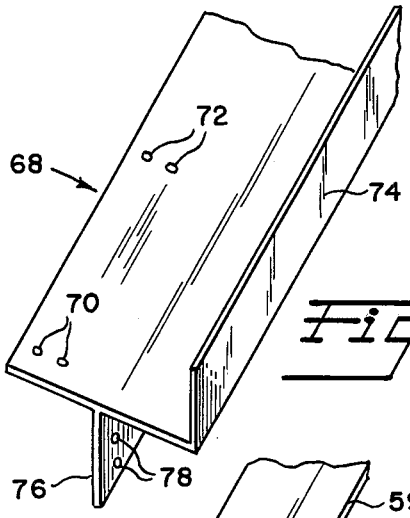
Fig. 6
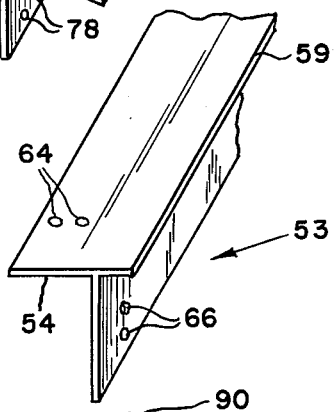
Fig. 7
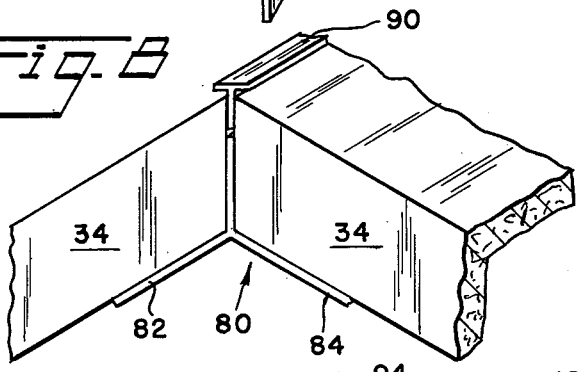
Fig. 8
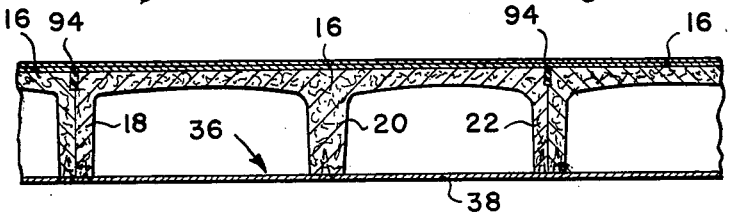
Fig. 9
Fig. 10
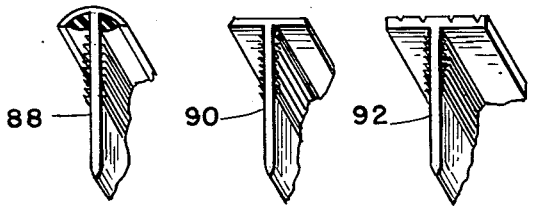

BUILDING CONSTRUCTION SYSTEM

DESCRIPTION OF THE INVENTION

The present invention is illustrated in the accompanying drawing and described in the following specification as including a novel prefabricated building construction or system which comprises a plurality of panels which are adapted to be readily secured together to form the exterior building walls as well as the roof structure, floors and partitions all compatible with each other and totally integrated. Novel securing means are provided by pre-drilled metal angle members which secure the panels together in the desired relationship, such members providing structural strength and stiffness during assembly and efficiently connecting all panel units together.

It is accordingly the principal object of the invention to provide a novel building construction system comprising similarly shaped panels which are adapted to serve as different structural elements in the assembly of the building, thus simplifying manufacture as well as reducing the cost of the building materials.

Another object is to provide a novel arrangement whereby the building panels may be quickly and easily assembled and/or disassembled and connected together, this feature being facilitated by the use of metal angle members which are pre-drilled for connection to the panel members.

Still another object is to provide the panel members with cut-away portions to provide hollow spaces for the reception of wiring, piping, insulation, duct work and other necessary accessories usually found in buildings and which are usually installed exteriorally of the building walls and partitions.

Still another object is to provide a building construction system including preformed panels and to construct the latter in such a manner that the faces of the panels which are directed to the exterior of the building are provided with weatherproof coatings which may be formed of any desired material such as plastic or paint.

Other objects and novel features of the invention will appear more fully hereinafter from a consideration of the accompanying drawings and description of the invention. It is to be expressly understood however, that the drawings are utilized for purposes of illustration only and are not to be taken as a definition of the limits of the invention, reference being had for this purpose to the appended claims.

Referring to the drawings wherein similar reference characters refer to similar parts throughout the several views:

FIG. 1 is a perspective view of a two-story house embodying the principle of the present invention;

FIG. 2 is a perspective view of a structural building panel forming an essential element of the invention;

FIG. 3 is an enlarged partial perspective view of a metal channel member for receivingthe base of the panel of FIG. 2 when the latter is employed as an exterior wall panel;

FIG. 4 is a fragmentary perspective view partly in section of a plurality of exterior wall panels and a floor panel;

FIG. 5 is a side view of a vertical wall panel with its upper end secured to a roof panel and illustrating the manner in which the wall panel is secured to a floor panel;

FIG. 6 is a partial view in perspective of the angle member associated with the roof panels;

FIG. 7 is a partial view in perspective of the angle member for supporting the floor panels from the exterior wall panels;

FIG. 8 is a partial view in perspective of the angle member for supporting the roof panels at the ridge of the roof;

FIG. 9 is a partial view in section taken along lines 9—9 of FIG. 5, and

FIG. 10 illustrates in perspective, three divider strips either of which may be employed to conceal the joints between adjacent panels.

Referring more particularly to FIG. 1, the present invention is illustrated therein as a prefabricated house built with the preformed panels to be later described herein. The house 10 includes vertically extending exterior wall panels 12 together with roof panels 14, the exterior surfaces of these panels being precoated with a suitable weatherproof finish of a desired color. If desired, and for architectural variation, some or all of the exterior wall panels may be left plain and faced with brick, stone or other material.

One of the important features of the invention resides in the formation and construction of the vertical exterior wall panels, the floor panels and the roof panels and the interconnection of all of these structural elements to fabricate the house or building. As shown in FIG. 2 for example, a vertical exterior wall panel 16, which may be of a length extending from the house footing to the roof of the house 10 is formed with an exterior flat face 17 and a plurality of spaced apart ribs 18, 20 and 22, the latter acting as conventional studs integrally formed with the face 17. Spaces 24 and 26 formed by the ribs may be used for wiring, insulation, ducts or other necessary building accessories. The panel 16 is preferably formed of wood particles with a suitable binder and the exterior face is provided with a suitable prefinished permanent coating 28 of plastic or other material.

Referring to FIGS. 4 and 5, an exterior wall panel 16 is illustrated therein as being connected to the footing 30 as well as to a floor panel 32 and a roof panel 34. It is here pointed out that the panels 32 and 34 are formed in a manner similar to the panel 16, as shown in FIG. 2. As shown in FIG. 5 and referring also to FIG. 3, a channel shaped angle member 36 is bolted at 39 to the footing 30, it being understood that a plurality of such members 36 are provided for receiving and supporting all of the exterior wall panels for the house. The lower portions of the wall panels 16 are supported between flanges 38 and 40 of the member 36 and flange 38 is received in recesses 37 formed in ribs 18, 20 and 22. Flange 38 is secured to the ribs 18, 20 and 22 by suitable screws projecting through holes 42 and 44 in the flange 38 and receivable in predrilled openings in the ribs. The angle member 36 is also provided with openings 45 and 46 for receiving the bolts 38 and drain opening 48 and 50 which connect the members 36 with a drainage channel 52 which may communicate with a sump pump.

A floor supporting channel member 53 is shown in FIGS. 5 and 7 as including a flange 54 which is received within a recess 55 and connected to the ribs 58, 60 and 62 of the floor panel 32 by suitable screws, projecting through openings 64 in the flange 54 and receivable in predrilled holes in the ribs of the floor panel, see FIG. 4. As shown, flange 56 is received within a recess 57 and is secured to the ribs 18, 20 and 22 of the panel 16 also be suitable screws projecting through holes 66 in the flange 56 and receivable in predrilled holes in the ribs. Flange 54 is provided with an extending lip 59 which fits within a slotted portion formed in each rib of the panels 16. It is understood that the channel members 53 extend completely around the interior surfaces of the ribs of the panels 16 in order to easily and efficiently support the floor panels.

The upper ends of the panels 16 are formed to support the roof panels 34 and as shown in FIGS. 5 and 6, the upper ends of the panels 16 support the roof panels 34 at the proper angle. A roof supporting angle member 68 has a flange 69 secured to the ribs of the roof panels by screws projected through holes 70 and 72 and receivable in predrilled holes in the ribs. Member 68 is formed with an upwardly extending flange 74 positioned within suitable slots formed in the ribs of the roof panels and said member is also provided with a depending flange 76 provided with openings 78 through which suitable screws project into prederilled openings in the ribs. As shown, the flanges 69 and 76 are received within recesses formed in the ribs of the panels 34 and 16. In this manner, the roof panels may be readily connected to the exterior wall panels to provide a firm and rigid construction. The preferred arrangement at the peak or ridge of the roof is shown in FIG. 8 which includes an angle member 80 having flanges 82 and 84 which are connected to the ribs of the roof panels by screw connections. Member 80 is also provided with a vertical flange 86 between the adjacent ends of the roof panels and a divider strip of the type shown at 88, 90 and 92 may be utilized to conceal and seal the joint between said ends of the roof panels.

FIG. 9 illustrates a group of wall panels 16 interconnected by the flange 38 of channel member 36 and it is here pointed out that all of the wall panels are provided with suitable factory installed sealing gaskets 94 extending throughout the said panel.

From the foregoing, the novel building construction system, stiffen the panels and connected channel and angle members will be readily understood. The panels are constructed of wood particles with a suitable binder and additives for fireproofing, insect proofing and rot proofing may be included. Outside wall finishes in a variety of colors, factory bonded to the exterior are utilized. The panels are light in weight and the provision of the space between the ribs may contain many of the necessary building accessories such as electrical wiring, insulation, etc. The use of the novel angle and channel members serves to outline the house, stiffen the entire structure and tie all of the wall, floor and roof units together into an integral system. In addition, the metal angle members perform the following functions: accurately position all panels, permanently tie all wall and floor panels together, transfer floor loads to wall panels, accurately level all floors and plumb all walls, act as lintels over all wall openings, transfer floor loads to both sides of openings, and stiffen entire structure particularly during construction. In addition to the above, it will be readily understood that the invention also provides the following advantages.

The panels are relatively narrow and long, thus providing full architectural freedom of moderately large units and not limited to a few stock designs as is the case with most prefabricated systems.

The system is totally integrated with wall, floor, roof and partition panels all of similar construction and all compatible with each other.

The wall panels extend from the basement or the first floor to the roof. The floor panels extend from the front wall to the back wall and the roof panels extend from the ridge to beyond the front or back walls.

The predrilled steel tie irons at each floor level function as:

a. Guides for erecting the entire structure;
b. Accurately position all panels;
c. Permanently tie all wall and floor units together;
d. Transfer floor loads to wall units;
e. Accurately level all floors and plumb all units;
f. Act as lintels over all wall openings to transfer floor loads to each side of openings;
g. Stiffen entire structure particularly during construction; and
h. Act as a rapid simple means of erecting the entire structure or dismantelling same.

Long narrow closure strips the length of the panel (similar to FIG. 10) with a variety of external finishes are used to close and seal the space between panels. About $\frac{1}{8}$ inch open space is allowed between each panel to allow for manufacturing and climate deviations in the panels. Outside closure strips rapidly and permanently seal these joints from water, wind, and dirt dirt penetration and provide a pleasing external finish.

While the invention has been described herein with considerable particularity it will be understood that the scope thereof is to be determined by the appended claims.

What is claimed:

1. In a building construction of the prefabricated type, the improvement which comprises a plurality of vertically arranged exterior wall panels arranged with their sides adjacent each other, each panel having an exterior prefinished side and being formed on the inner side with a plurality of spaced-apart vertical ribs extending throughout the length of the panel, a floor supporting angle member for supporting a plurality of horizontally arranged floor panels from said ribs, each floor panel including a plurality of spaced-apart horizontal ribs on its under side, said angle member comprising a vertical flange secured to said vertical ribs and a horizontal flange secured to said horizontal ribs the ribs of the exterior wall panels and the ribs of the floor panels being provided with recesses to respectively receive the vertical and horizontal flanges of the floor supporting angle member, the depth of the recesses being such as to accommodate the respective flanges to preserve the continuity of the surfaces of said ribs, the horizontal flange of the floor supporting angle member being provided with a lateral extension and the faces of the ribs of the exterior wall panels being provided with slots for receiving said extension.

* * * * *